US008085221B2

(12) United States Patent
Yoshihama et al.

(10) Patent No.: US 8,085,221 B2
(45) Date of Patent: Dec. 27, 2011

(54) METHOD OF DRIVING PLASMA DISPLAY PANEL AND PLASMA DISPLAY UNIT

(75) Inventors: Yutaka Yoshihama, Osaka (JP); Shigeo Kigo, Osaka (JP); Kazuyoshi Nakamura, Osaka (JP); Kenji Sasaki, Osaka (JP); Fumito Kusama, Osaka (JP)

(73) Assignee: Panasonic Corporation, Osaka (JP)

( * ) Notice: Subject to any disclaimer, the term of this patent is extended or adjusted under 35 U.S.C. 154(b) by 1152 days.

(21) Appl. No.: 11/885,430

(22) PCT Filed: Feb. 13, 2007

(86) PCT No.: PCT/JP2007/052472

§ 371 (c)(1),
(2), (4) Date: Aug. 31, 2007

(87) PCT Pub. No.: WO2007/094293

PCT Pub. Date: Aug. 23, 2007

(65) Prior Publication Data

US 2009/0009435 A1 Jan. 8, 2009

(30) Foreign Application Priority Data

Feb. 14, 2006 (JP) ..... 2006-036321
Feb. 14, 2006 (JP) ..... 2006-036322
Feb. 14, 2006 (JP) ..... 2006-036323
Feb. 14, 2006 (JP) ..... 2006-036324

(51) Int. Cl.
*G09G 3/28* (2006.01)

(52) U.S. Cl. ..... 345/63; 315/169.1

(58) Field of Classification Search ..... 345/60–69
See application file for complete search history.

(56) References Cited

U.S. PATENT DOCUMENTS 4,866,349 A 9/1989 Weber et al.
6,559,603 B2 * 5/2003 Iwami ..... 315/169.1
7,050,022 B2 5/2006 Kigo et al.
7,468,713 B2 12/2008 Ogawa et al.
7,619,592 B2 * 11/2009 Chang et al. ..... 345/68
2003/0169214 A1 * 9/2003 Kigo et al. ..... 345/60
2004/0239592 A1 * 12/2004 Okada ..... 345/63
2007/0035479 A1 * 2/2007 Lin et al. ..... 345/68

FOREIGN PATENT DOCUMENTS

JP 07-109542 11/1995

(Continued)

*Primary Examiner* — Duc Dinh
(74) *Attorney, Agent, or Firm* — Wenderoth, Lind & Ponack, L.L.P.

(57) ABSTRACT

A method drives a panel and a plasma display unit, wherein one field includes a plurality of subfields, each having an addressing period for producing an address discharge selectively in the discharge cells, and a sustaining period for producing a sustain discharge by applying a number of sustaining pulses corresponding to a weight of brightness in a discharge cell where the address discharge has been produced. Additionally, a sustaining pulse generator circuit includes a power recovery section for controlling the rising or the falling of the sustaining pulse by producing resonance between an inter-electrode capacitance of a display electrode pair and an inductor, and a clamping section for clamping a voltage of the sustaining pulse at a predetermined potential, wherein the power recovery section is used to set twice a time of the rising of the sustaining pulse to be equal to or longer than a duration of the sustaining pulse.

10 Claims, 12 Drawing Sheets

FOREIGN PATENT DOCUMENTS

| | | |
|---|---|---|
| JP | 2000-242224 | 9/2000 |
| JP | 2002-162932 | 6/2002 |
| JP | 2003-076321 | 3/2003 |
| JP | 2004-206094 | 7/2004 |
| JP | 2006-3398 | 1/2006 |
| JP | 2006-030433 | 2/2006 |
| JP | 2006-30433 | 2/2006 |
| KR | 10-2004-0010769 | 1/2004 |

* cited by examiner

FIG. 12

| APL | <20% | 20%≦& <25% | 25%≦& <35% | 35%≦& <50% | ≧50% |
|---|---|---|---|---|---|
| Subfield * | SF8, 9, 10 | SF9,10 | SF9,10 | SF10 | SF10 |
| Overlapping period | 450nsec | 400nsec | 350nsec | 300nsec | 250nsec |
| Rise time | 900nsec | 900nsec | 900nsec | 900nsec | 900nsec |
| Fall time | 650nsec | 700nsec | 750nsec | 800nsec | 850nsec |
| Sustaining period | 850nsec | 950nsec | 1050nsec | 1150nsec | 1250nsec |
| Sustaining cycle | 3900nsec | 4300nsec | 4700nsec | 5100nsec | 5500nsec |

FIG. 13

| | | | | | |
|---|---|---|---|---|---|
| Sustaining cycle (Excluding pulses below) | 5μsec | 4μsec | 4μsec | 4μsec | 4μsec |
| Sustaining cycle (Just before erase discharge) | 5μsec | 4μsec | 5μsec | 5μsec | 5μsec |
| Sustaining cycle (Second before erase discharge) | 5μsec | 4μsec | 4μsec | 5μsec | 5μsec |
| Sustain cycle (Third before erase discharge) | 5μsec | 4μsec | 4μsec | 4μsec | 5μsec |
| Addressing voltage | 62.0 (V) | 66.5 (V) | 62.0 (V) | 62.0 (V) | 62.0 (V) |

METHOD OF DRIVING PLASMA DISPLAY PANEL AND PLASMA DISPLAY UNIT

This application is a U.S. National Phase Application of PCT International Application PCT/JP2007/052472.

BACKGROUND OF THE INVENTION

1. Technical Field

The present invention relates to a method of driving plasma display panels used for wall-mounted televisions and large-scale monitors. The invention also relates to plasma display units.

2. Background Art

A typical AC surface-discharge type panel known as plasma display panel (hereinafter referred to as "panel") comprises a large number of discharge cells formed between a front plate and a rear plate arranged in a confronting manner. The front plate comprises a plurality of display electrode pairs, each consisting of a combination of a scan electrode and a sustain electrode formed in parallel to each other on a front glass substrate, and a dielectric layer and a protective layer overlaid to cover the display electrode pairs. The rear plate comprises a plurality of parallel-oriented data electrodes, a dielectric layer covering the data electrodes, and a plurality of barrier ribs in parallel to the data electrodes, formed one after another on a rear glass substrate. In addition, phosphor layers are formed over the dielectric layer as well as side surfaces of the barrier ribs. The front plate and the rear plate are placed in a confronting arrangement so that the display electrode pairs and the data electrodes crisscross with respect to each other with a space between them, and the plates are then sealed hermetically. The interior, or the discharge space, is filled with discharge gases including, for instance, xenon gas of 5% in a ratio of partial pressure. Discharge cells are thus formed in areas where the display electrode pairs and the data electrodes confront each other. In the panel of the above structure, gas-discharges inside the individual discharge cells generate ultraviolet rays, which in turn excite the individual phosphors of red (R), green (G) and blue (B) colors to cause luminous emission and display color images.

As a method of driving the panel, it is a general practice to use the subfield method, which is to divide a period of one field into a plurality of subfields, and combine selected subfields to be lighted to display gradation. Each subfield consists of a priming period, an addressing period and a sustaining period, wherein a priming discharge is produced during the priming period to create a wall charge necessary for the subsequent addressing operation on the individual electrode. During the addressing period, an address discharge is produced to create a wall charge selectively in a discharge cell to be lighted for display. During the sustaining period, sustaining pulses are applied alternately to the display electrode pair consisting of the scan electrode and the sustain electrode to produce a sustain discharge in the discharge cell where the address discharge was produced to cause luminous emission of the phosphor layer of the corresponding discharge cell for display of an image.

A variety of energy saving techniques have been proposed for plasma display units of this kind to reduce power consumption. In view of the fact that each of the display electrode pairs is regarded as a capacitive load having an inter-electrode capacitance between the electrode pair, there is disclosed a so-called power recovery circuit as one of the techniques to reduce power consumption especially during the sustaining period, wherein a resonance circuit formed of an inductor component is used to produce an L-C resonance between the inductor and the inter-electrode capacitance, recover electric charge accumulated in the inter-electrode capacitance into a power recovery capacitor, and reuse the recovered electric charge to drive the display electrode pairs (refer to patent document 1, for example).

Also disclosed is a new way of driving in the subfield method, which uses a gradually changing voltage waveform to produce a priming discharge, and reduces luminous emission not relevant to the display of gradation to a maximum extent possible to improve the contrast ratio by producing the priming discharge selectively in certain discharge cells where sustain discharges was made (refer to patent document 2, for example).

There is a tendency in recent years toward increase in power consumption of panels due to introduction of a variety of techniques to enhance high brightness in addition to increase in resolution as well as a strong inclination toward larger screens, all of which demand further reduction of power consumption.

Patent Document 1: Japanese Patent Publication, No. H07-109542

Patent Document 2: Japanese Patent Laid-Open Publication, No. 2000-242224

SUMMARY OF THE INVENTION

The present invention provides a method of driving panels capable of reducing power consumption while achieving high brightness, as well as plasma display units using the invented method.

The method of driving panels according to the present invention is a way to drive a plasma display panel provided with a plurality of discharge cells, each having a display electrode pair formed of a scan electrode and a sustain electrode, and that one field comprises a plurality of subfields, each having an addressing period for producing an address discharge selectively in any of the discharge cells, and a sustaining period for producing a sustain discharge by applying a number of sustaining pulses corresponding to a weight of brightness in the discharge cell where the address discharge was produced. The method comprises a step of rising or falling the sustaining pulses by producing resonance between inter-electrode capacitance of the display electrode pair and an inductor, a step of clamping a voltage of the sustaining pulses at a predetermined potential, and a step of setting a time of the sustaining pulses so that twice a time of rising the sustaining pulses becomes equal to or longer than a duration thereof.

The plasma display unit of the present invention comprises a plasma display panel provided with a plurality of discharge cells, each having a display electrode pair formed of a scan electrode and a sustain electrode, and a sustaining pulse generator circuit for applying a sustaining pulse to each of the display electrode pairs to generate a sustain discharge. The sustaining pulse generator circuit comprises a power recovery section for rising or falling the sustaining pulse by producing resonance between an inter-electrode capacitance of the display electrode pair and an inductor, and a clamping section for clamping a voltage of the sustaining pulse at a predetermined potential, wherein the power recovery section regulates the sustaining pulse so that twice a time of rising the sustaining pulse becomes equal to or longer than a duration thereof. Here, the term "duration" means a period of time in which the voltage of the sustaining pulse is clamped at the predetermined potential.

As a result, the invention achieves a substantial reduction of the power consumption.

BRIEF DESCRIPTION OF DRAWINGS

FIG. 12 is a table showing a relation between APL and waveform of the sustaining pulse in the plasma display unit according to the exemplary embodiment of the invention;

FIG. 13 is a table showing a relation between sustaining cycle, duration and addressing voltage.

REFERENCE MARKS IN THE DRAWINGS

Figure 1:
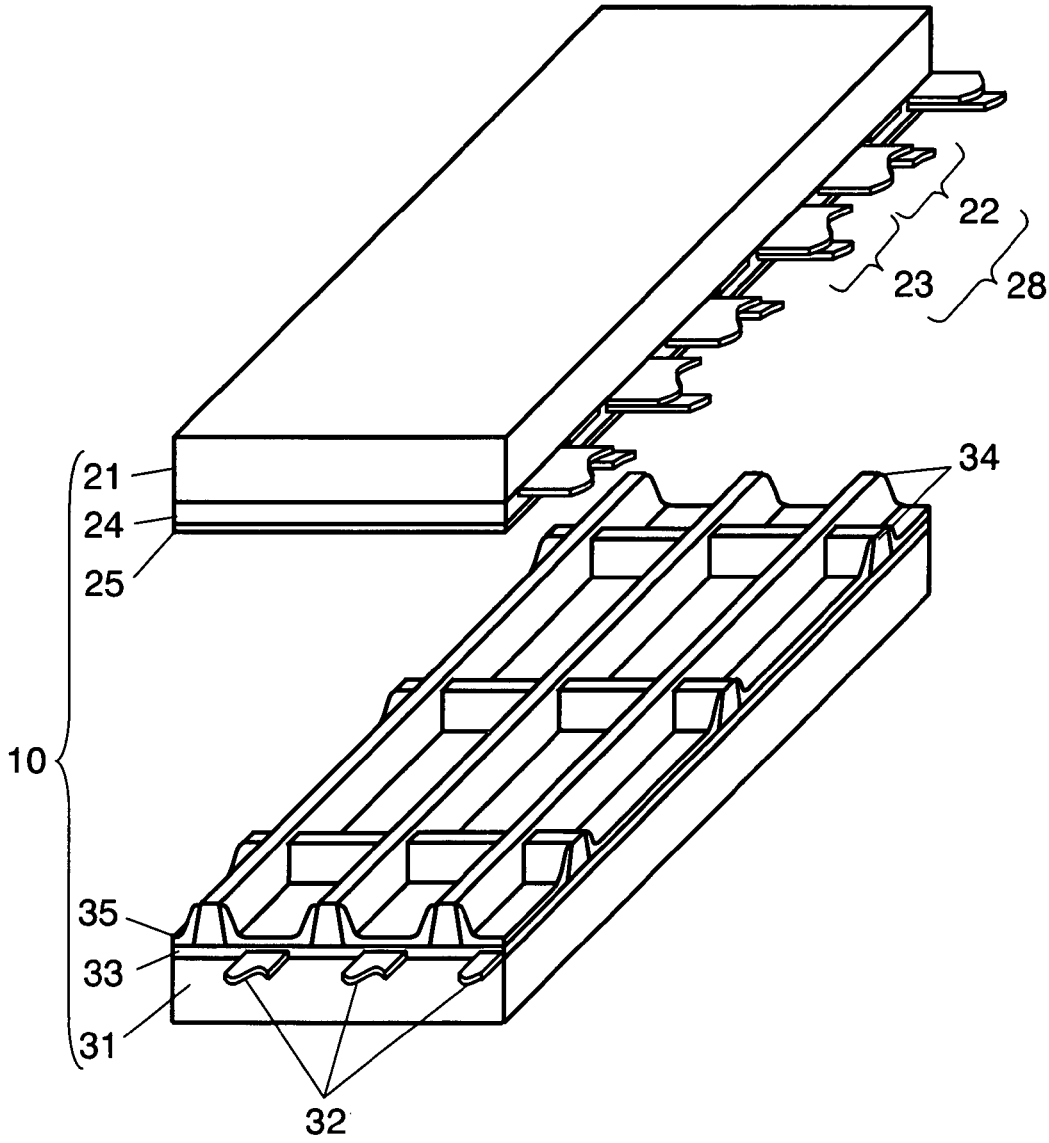
FIG. 1 is an exploded perspective view showing a structure of a panel according to an exemplary embodiment of the present invention.

1 plasma display unit
10 panel
21 front plate made of glass
22 scan electrode
23 sustain electrode
24 and 33 dielectric layer
25 protective layer
28 display electrode pair
31 rear plate
32 data electrode
34 barrier rib
35 phosphor layer
51 image signal processing circuit
52 data electrode driver circuit
53 scan electrode driver circuit
54 sustain electrode driver circuit
55 timing generator circuit
58 APL detector circuit
100 and 200 sustaining pulse generator circuit
110 and 210 power recovery section
120 and 220 voltage clamping section
C10 and C20 power recovery capacitor
Cp inter-electrode capacitance
Q11, Q12, Q13, Q14, Q21, Q22, Q23, Q24, Q28 and Q29 switching element
D11, D12, D21 and D22 reverse-current blocking diode
L11, L12, L21 and L22 inductor

DETAILED DESCRIPTION OF THE INVENTION

Referring now to the drawings, description is provided hereinafter of a plasma display unit according to exemplary embodiments of the present invention.

Exemplary Embodiment

FIG. 1 is an exploded perspective view showing a structure of panel 10 according to one exemplary embodiment of the present invention. Front plate 21 made of a glass has a plurality of display electrode pairs 28, each formed of scan electrode 22 and sustain electrode 23, formed on it. There is also dielectric layer 24 formed in a manner to cover scan electrodes 22 and sustain electrodes 23, and protective layer 25 formed on dielectric layer 24. Rear plate 31 has a plurality of data electrodes 32 formed on it, dielectric layer 33 formed to cover data electrodes 32, and lattice-like barrier ribs 34 also formed on top of them. In addition, phosphor layers 35 are formed on side surfaces of barrier ribs 34 and top surface of dielectric layer 33 for making luminous emission of each of red (R), green (G) and blue (B) colors.

Front plate 21 and rear plate 31 are placed in a confronting arrangement so that display electrode pairs 28 and data electrodes 32 crisscross with respect to each other with a small discharge space between them, and their outer peripheries are hermetically sealed with a sealing material such as glass frit. The discharge space is filled with discharge gases comprised of, for example, a mixture of neon and xenon gases. In order to improve the brightness, the discharge gases used in this exemplary embodiment contain xenon gas of 10% in a ratio of partial pressure. The discharge space is divided by barrier ribs 34 into a plurality of sections, so that discharge cells are formed in these sections where display electrode pairs 28 and data electrodes 32 crisscross one another. Electrical discharges are generated in the individual discharge cells to produce luminous emission and to display images.

It should be understood that the structure of the panel is not limited to that illustrated above, but it may be provided with barrier walls of a striped configuration, for example.

Figure 2:
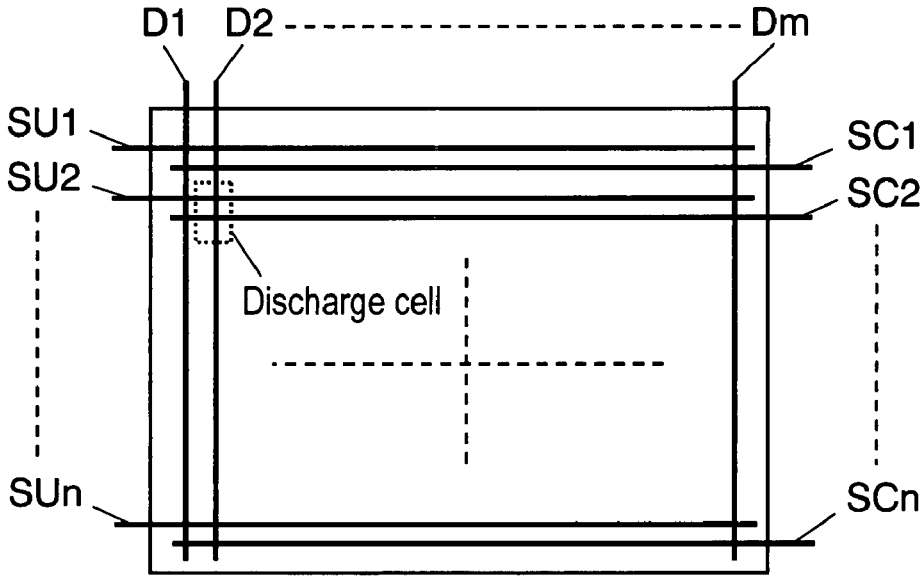
FIG. 2 is a schematic illustration showing an array of electrodes of the panel according to the exemplary embodiment of the invention.

FIG. 2 is a schematic illustration showing an array of electrodes of panel 10 according to this exemplary embodiment of the invention. Panel 10 has "n" rows of scan electrodes SC1 through SCn (scan electrodes 22 in FIG. 1) and "n" rows of sustain electrodes SU1 through SUn (sustain electrodes 23 in FIG. 1) arranged in a laterally extending manner, and "m" rows of data electrodes D1 through Dm (data electrodes 32 in FIG. 1) arranged in a downwardly extending manner. Each of the discharge cells is formed in an area where a pair of scan electrode SCi and sustain electrode SUi (where i=1 to n) crisscrosses a data electrode Dj (where j=1 to m), so that discharge cells in total number of m×n are formed in the discharge space. There exists a large inter-electrode capacitance Cp between scan electrodes SC1 through SCn and sustain electrodes SU1 through SUn since scan electrode SCi and sustain electrode SUi are formed in parallel to each other, as shown in FIG. 1 and FIG. 2.

Figure 3:
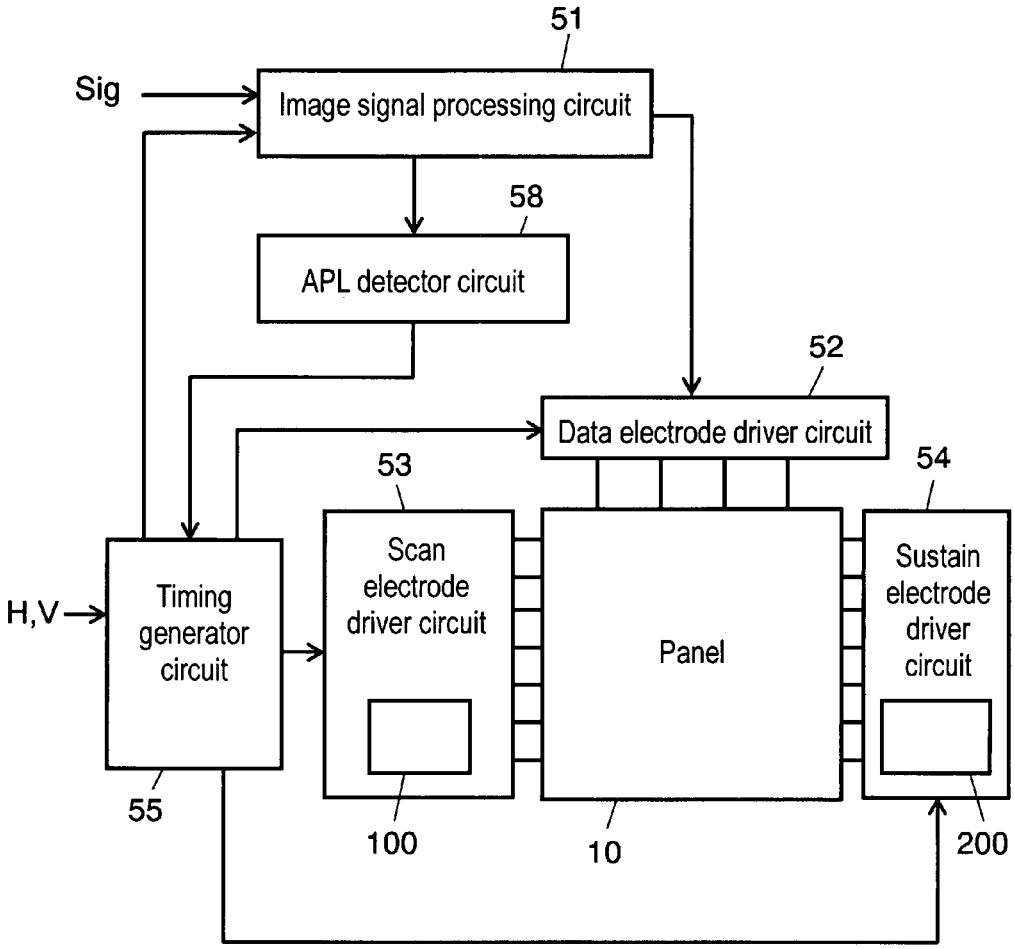
FIG. 3 is a circuit block diagram of a plasma display unit according to the exemplary embodiment of the invention.

FIG. 3 is a circuit block diagram of plasma display unit 1 according to this exemplary embodiment of the invention. Plasma display unit 1 is provided with panel 10, image signal processing circuit 51, data electrode driver circuit 52, scan electrode driver circuit 53, sustain electrode driver circuit 54, timing generator circuit 55, APL detector circuit 58, and a power supply circuit (not shown) for supplying electric power necessary for the individual circuit blocks.

Image signal processing circuit 51 converts image signal "sig" input thereto into an image data showing lighting or no-lighting in each subfield. Data electrode driver circuit 52 converts the image data for each subfield into a signal corresponding to each of data electrodes D1 through Dm, and drives the individual data electrodes D1 through Dm. APL detector circuit 58 detects an average brightness level (hereinafter referred to as "APL") of the image signal "sig". More concretely, detector circuit 58 detects the APL by using any such generally known technique as the one which is to integrate brightness values in image signals through a period of one field or one frame.

Timing generator circuit 55 generates a variety of timing signals for controlling operation of the individual circuit blocks based on a horizontal synchronizing signal H, vertical synchronizing signal V and APL detected by APL detector circuit 58, and supplies them to the respective circuit blocks. Scanning electrode driver circuit 53 has sustaining pulse generator circuit 100 for generating sustaining pulses to be applied to scan electrodes SC1 through SCn during their sustaining periods, and drives the individual scan electrodes SC1 through SCn according to the respective timing signals. Sustain electrode driver circuit 54 has a circuit for supplying voltage Ve1 on sustain electrodes SU1 through SUn during the priming periods, and sustaining pulse generator circuit 200 for generating sustaining pulses to be applied to sustain electrodes SU1 through SUn during the sustaining periods, and drives sustain electrodes SU1 through SUn according to the timing signals.

Description is provided next of waveforms of driving voltages for driving panel 10 and functions thereof. Plasma display unit 1 displays gradation by using the subfield method, which is to divide a period of one field into a plurality of subfields, and to control lighting and no-lighting of the individual discharge cells in each subfield. Each of the subfield consists of a priming period, an addressing period and a sustaining period. In the priming period, a priming discharge is produced to create a wall charge necessary for the subsequent address discharge on the individual electrodes. There are different methods of the priming operation, of which one is to produce the priming discharge in all of the discharge cells (hereinafter referred to as "the whole cell priming operation"), and another is to produce the priming discharge only in the discharge cells where sustain discharges were produced (which is referred to as "the selective priming operation"). During the addressing period, an address discharge is produced to create a wall charge selectively in each of the discharge cells to be lighted. During the sustaining period, a number of sustaining pulses proportional to a weight of the brightness are applied alternately to display electrode pairs to produce sustain discharges in the discharge cells where the address discharges were produced, to thereby cause luminous emissions therein. A constant of proportionality used here is called a multiplying factor of the brightness. Description is now provided of waveforms of the driving voltages in the subfield and their functions, while details of configuration of the subfield will be discussed later.

Figure 4:
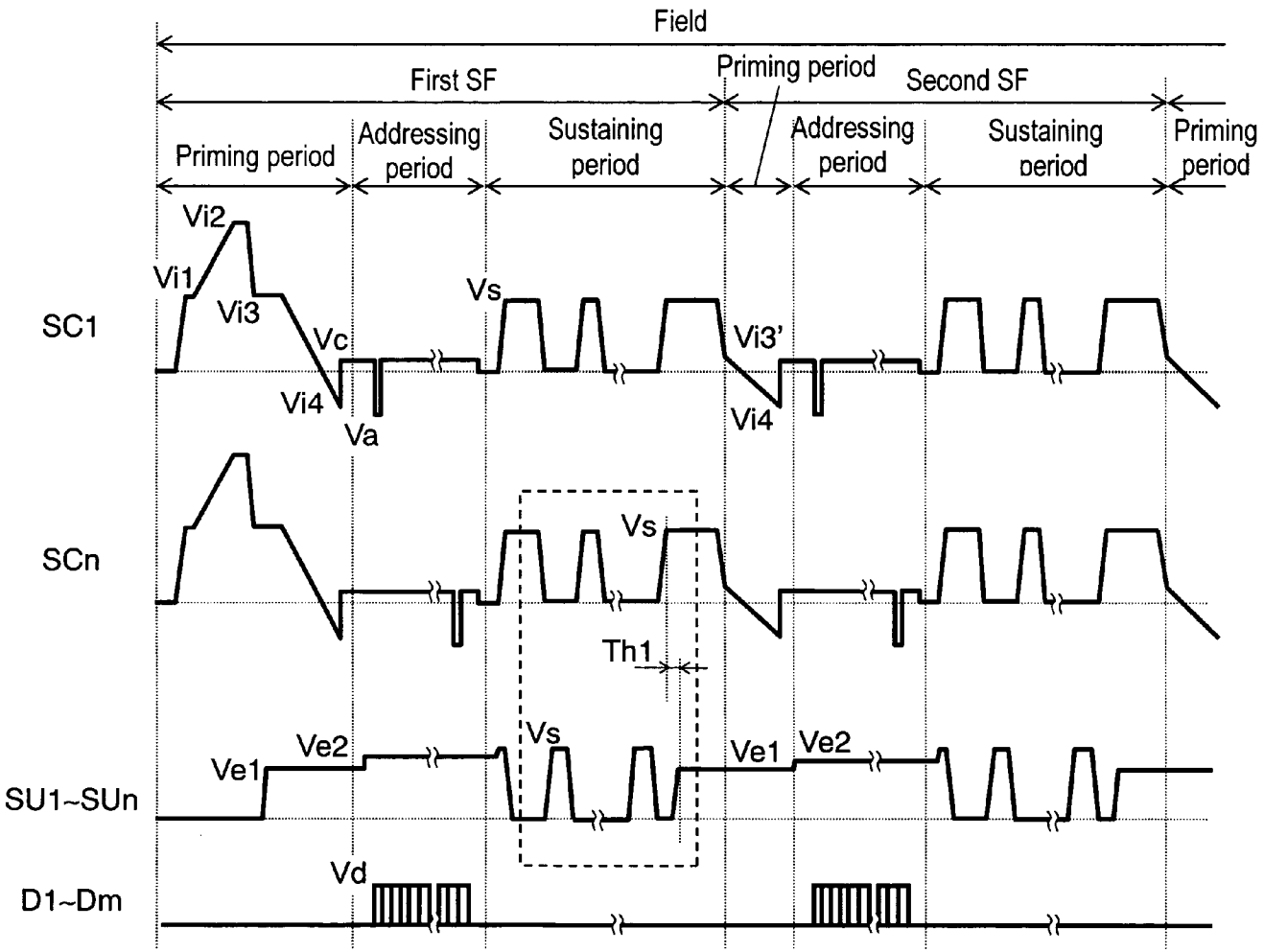
FIG. 4 is a schematic illustration showing waveforms of driving voltages applied to individual electrodes of the panel according to the exemplary embodiment of the invention.

FIG. 4 is a schematic illustration showing waveforms of the driving voltages applied to the individual electrodes of panel 10 according to this exemplary embodiment of the invention. FIG. 4 shows a subfield wherein the whole cell priming operation is carried out, and another subfield wherein the selective priming operation is carried out.

Described first pertains to the subfield wherein the whole cell priming operation is made.

In the first half of the priming period, no voltage is applied to data electrodes D1 through Dm and sustain electrodes SU1 through SUn respectively, and a voltage having an upwardly sloped waveform is applied to scan electrodes SC1 through SCn, wherein this voltage gradually rises in potential form a value Vi1 which is below a discharge starting voltage with respect to sustain electrodes SU1 through SUn toward another value Vi2 which exceeds the discharge starting voltage. While this voltage is in the state of rising in potential, there occurs weak priming discharges from scan electrodes SC1 through SCn to sustain electrodes SU1 through SUn and data electrodes D1 through Dm respectively. This creates negative wall voltages being accumulated over scan electrodes SC1 through SCn, and positive wall voltages accumulated over data electrodes D1 through Dm and sustain electrodes SU1 through SUn. Here, the wall voltages over the electrodes mean voltage potentials produced by the wall charges accumulated over upper surfaces of the dielectric layer, the protective layer and the phosphor layers covering the electrodes.

In the last half of the priming period, a positive voltage Ve1 is applied to sustain electrodes SU1 through SUn, and a voltage having a downwardly sloped waveform is applied to scan electrodes SC1 through SCn, wherein this voltage (referred to as "lamp voltage") gradually decreases in potential form a value Vi3 which is below the discharge starting voltage with respect to sustain electrodes SU1 through SUn toward another value Vi4 which exceeds the discharge starting voltage. During this period, there occurs weak priming discharges from scan electrodes SC1 through SCn to sustain electrodes SU1 through SUn and data electrodes D1 through Dm respectively. This decreases the negative wall voltages over scan electrodes SC1 through SCn as well as the positive wall voltages over sustain electrodes SU1 through SUn, so as to adjust the positive wall voltages over data electrodes D1 through Dm to a potential suitable for the addressing operation. The above processes complete the whole cell priming operation to carry out the priming discharges in all of the discharge cells.

In the subsequent addressing period, voltage Ve2 is applied to sustain electrodes SU1 through SUn, and voltage Vc is applied to scan electrodes SC1 through SCn. Scanning pulse voltage Va of a negative potential is then applied to scan electrode SC1 of the first row, and addressing pulse voltage Vd of a positive potential is applied to data electrode Dk (where k=any of 1 through m) belonging to the discharge cell to be lighted in the first row amongst data electrodes D1 through Dm. A difference in voltage potential at this moment in the crisscrossing point between data electrode Dk and scan electrode SC1 comes to the sum of the difference in potential of the externally applied voltages (i.e., Vd−Va) and a difference in potential between the wall voltages on data electrode Dk and scan electrode SC1, which exceeds the starting voltage of discharge. This causes address discharges between data electrode Dk and scan electrode SC1 as well as between sustain electrode SU1 and scan electrode SC1, which create accumulation of a positive wall voltage on scan electrode SC1, a negative wall voltage on sustain electrode SU1 and another negative wall voltage on data electrode Dk. The addressing operation for accumulating the wall voltages on the individual electrodes is carried out in this manner by producing the address discharges in the discharge cell to be lighted in the first row. On the other hand, no address discharges take place in the crisscrossing points between data electrodes D1 through Dm and scan electrode SC1 where voltages there do not exceed the discharge starting voltage since the addressing pulse voltage Vd is not applied to data electrodes D1 through Dm. The addressing period ends when the addressing operation is repeated in the above manner for all the discharge cells up to the n-th row.

Although a power recovery circuit is used for driving the electrodes to save energy in the subsequent sustaining period, details of waveforms of its driving voltages will be described later. Instead, description is provided here of an outline of sustaining operation in the sustaining period. Sustaining pulse voltage Vs of a positive potential is applied first to scan electrodes SC1 through SCn, while no voltages are applied to sustain electrodes SU1 through SUn. This results in a difference in voltage potential between scan electrode SCi and sustain electrode SUi to become the sum of the difference in potential between the wall voltages on scan electrode SC1 and sustain electrode SUi added to the sustaining pulse voltage Vs, and this potential exceeds the discharge starting voltage in the discharge cell where the address discharge occurred in the preceding addressing period. It thus causes a sustain discharge between scan electrode SCi and sustain electrode SUi to generate the ultraviolet rays, which in turn makes phosphor layer 35 produce luminous emission. Consequently, there occurs a negative wall voltage accumulated on scan electrode SCi and a positive wall voltage on sustain electrode SUi. There is also a positive wall voltage accumulated on data electrode Dk. There are no sustain discharges to occur in other discharge cells where address discharges did not take place in the addressing period, and the wall voltages at the end of the priming period are therefore kept unchanged.

Following the above, the voltage applied to scan electrodes SC1 through SCn is reduced to zero volt, whereas sustaining pulse voltage Vs is applied to sustain electrodes SU1 through SUn respectively. This causes the sustain discharge to restart again between sustain electrode SUi and scan electrode SCi since the difference in potential between sustain electrode SUi and scan electrode SCi exceeds the discharge starting voltage in the discharge cell where the sustain discharge took place, and produces accumulation of a negative wall voltage on sustain electrode SUi and a positive wall voltage on scan electrode SCi. Sustain discharges are carried out continuously in the same manner in the discharge cells where the address discharges took place in the preceding addressing period by creating differences in voltage potential between scan electrodes SC1 through SCn and sustain electrodes SU1 through SUn by way of alternately applying to these electrodes of the display electrode pairs with the sustaining pulses in the number corresponding to the weight of brightness multiplied by the multiplying factor of brightness.

At the end of the sustaining period, a difference in voltage potential of a short duration, or a narrow-width pulse, is provided between scan electrodes SC1 through SCn and sustain electrodes SU1 through SUn to eliminate all or a part of the wall voltages on scan electrode SCi and sustain electrode SUi while leaving the positive wall voltage on data electrode Dk. To be more specific, sustaining pulse voltage Vs is applied to scan electrodes SC1 through SCn only after the voltage to sustain electrodes SU1 through SUn is once reduced to zero volt. This produces a sustain discharge between sustain electrode SUi and scan electrode SCi of the discharge cell in which the sustain discharge took place previously. Voltage Ve1 is then applied to sustain electrodes SU1 through SUn before the electric discharge comes to end, that is, while charged particles generated by the electric discharge still remain adequately in the discharge space. In this way, the difference in voltage potential between sustain electrode SUi and scan electrode SCi is reduced to a level of about (Vs–Ve1). As a result, the wall voltages between scan electrodes SC1 through SCn and sustain electrodes SU1 through Sun can be reduced to a level approximately equal to the difference of voltages applied to the respective electrodes, or (Vs–Ve1), while the positive wall voltage on data electrode Dk is left unchanged. The electric discharge produced here is hereinafter referred to as "erase discharge".

As described, the voltage Ve1 is applied to sustain electrodes SU1 through SUn to reduce the difference in voltage potential between the electrodes of the display electrode pairs after a predetermined time interval (hereinafter referred to as "erase phase difference Th1") following the application of voltage Vs to scan electrodes SC1 through SCn for generating the last sustain discharge, or the erase discharge. The sustaining operation in the sustaining period is completed in this manner.

Description is now provided of an operation in the subfield where selective priming operation is made.

In the priming period for carrying out selective priming, a voltage Ve1 is applied to sustain electrodes SU1 through SUn, no voltage is applied to data electrodes D1 through Dm, and a lamp voltage z potential of which decreases gradually from value Vi3 toward another value Vi4 is applied to scan electrodes SC1 through SCn respectively. This creates a weak priming discharge in the discharge cell where the sustain discharge took place during the sustaining period of the previous subfield, and decreases the wall voltages on scan electrode SCi and sustain electrode SUi. Since data electrode Dk carries a sufficient level of the positive wall voltage accumulated by the preceding sustain discharge, it also discharges an excessive portion of this wall voltage to adjust it to the potential suitable for the addressing operation. On the other hand, there are no discharges in the other discharge cells where sustain discharges did not occur in the previous subfield, so that they maintain the wall charges intact from the end of the priming period in the previous subfield. As described, the selective priming operation is to carry out the priming discharge selectively in the discharge cell where the sustaining operation is made during the sustaining period in the previous subfield.

Operation in the succeeding addressing period is similar to that of the addressing period in the subfield wherein the whole cell priming operation is made, and details of it is therefore skipped. It is noted that operation in the subsequent sustaining period is also identical except for a number of the sustaining pulses.

Description is provided next of a configuration of subfields.

Figure 5:
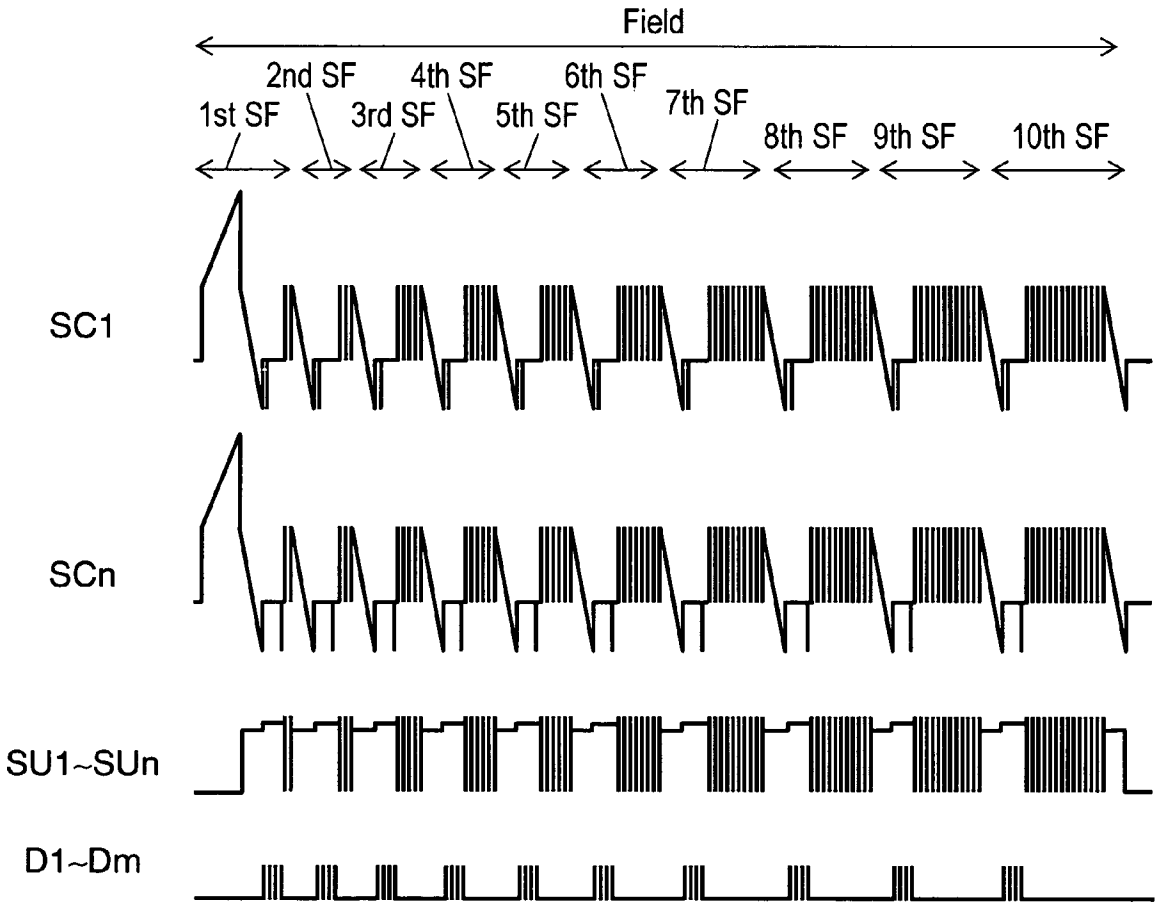
FIG. 5 is a schematic illustration showing a configuration of subfields according to the exemplary embodiment of the invention.

FIG. 5 is a schematic illustration showing the configuration of the subfields according to this exemplary embodiment of the invention. Assumption is made in this exemplary embodiment, that one field is divided into ten subfields (i.e., first SF, second SF, - - - tenth SF), and that the individual subfields have their respective weights of brightness of 1, 2, 3, 6, 11, 18, 30, 44, 60, 80, in this example. It is also assumed that the whole cell priming operation is carried out in the priming period of the first SF, and the selective priming operation is carried out in the priming periods of the second SF to the tenth SF. During the sustaining period in each of the subfields, sustaining pulses of a number given by multiplication of the weights of brightness of the corresponding subfield and a predetermined multiplying factor of brightness is applied to the individual display electrode pairs.

It should be noted, however, that the number of subfields and the weight of brightness in each subfield as illustrated above are not meant to restrict the present invention. The invention can also be embodied in such other way that the subfield configuration is changeable in response to an image signal and the like.

Described next is details of sustaining pulse generator circuits 100 and 200, and how they operate.

Figure 6:
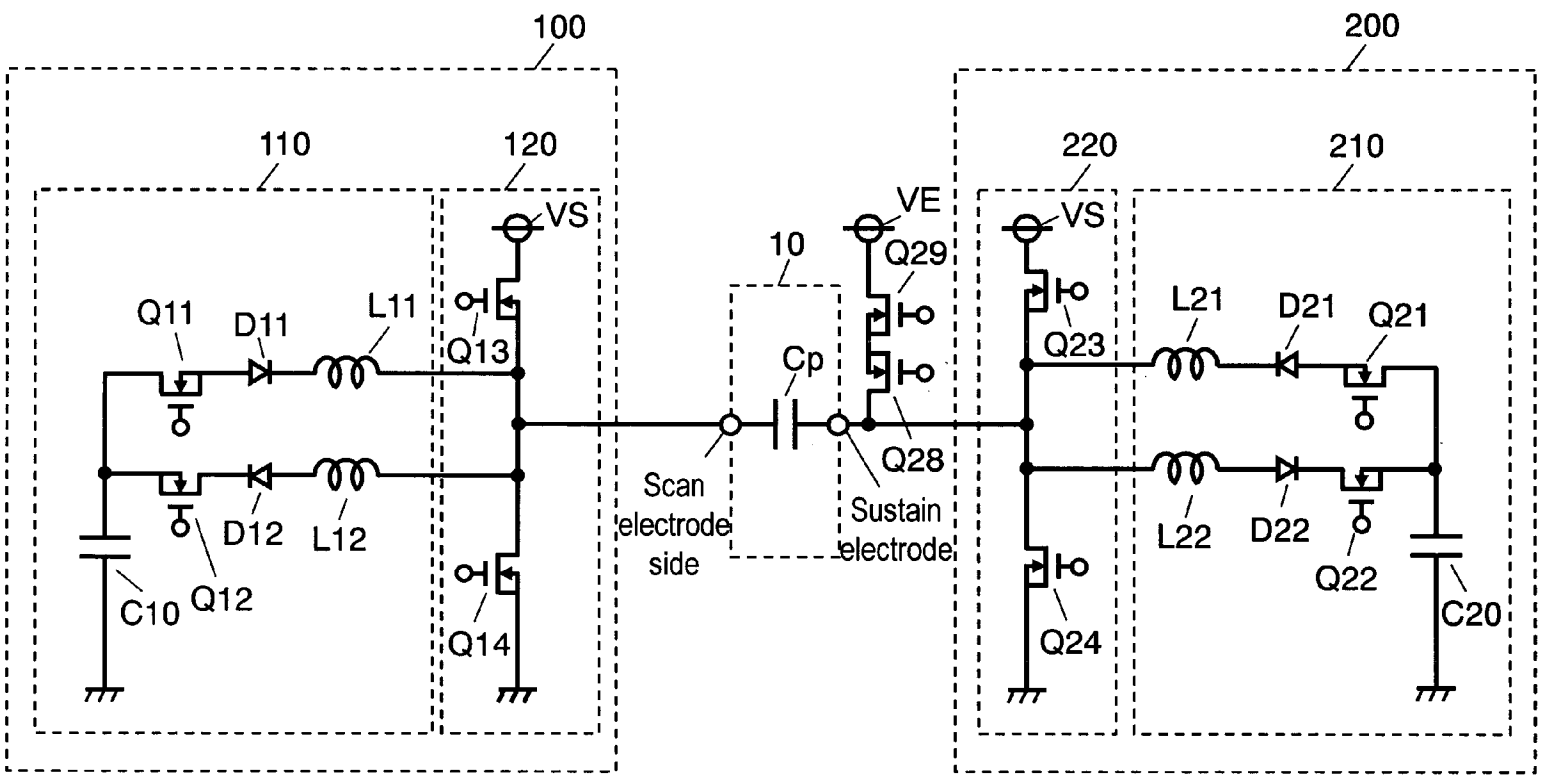
FIG. 6 is a circuit diagram of a sustaining pulse generator circuit according to the exemplary embodiment of the invention.

FIG. 6 is a circuit diagram of sustaining pulse generator circuits 100 and 200 according to this exemplary embodiment of the invention. In FIG. 6, reference mark Cp represents the inter-electrode capacitance of panel 10, and this diagram omits related circuits that generate scanning pulses and priming voltage waveform.

Sustaining pulse generator circuit 100 comprises power recovery section 110 and clamping section 120. Power recovery section 110 has capacitor C10 for recovering electric power, switching elements Q11 and Q12, reverse-current blocking diodes D11 and D12, and resonance inductors L11 and L12. Clamping section 120 has switching elements Q13 and Q14. Power recovery section 110 and clamping section 120 are connected to scan electrodes 22 represented here by one side of inter-electrode capacitance Cp via a scanning pulse generator circuit (not shown in the figure since this circuit is in a short-circuit mode during the sustaining period). Both inductors L11 and L12 are designed to have inductances of a value, of which a resonance cycle with inter-electrode capacitance Cp becomes longer than a time duration of the sustaining pulse. The resonance cycle here means a period of one cycle obtained by L-C resonance. When an inductance of the inductor and a capacitance of the capacitor are denoted as L and C respectively, for instance, the resonance cycle can be obtained by the formula of "$2\pi\sqrt{(L\cdot C)}$". Accordingly, inductance L in this formula represents the inductance of any of inductors L11 and L12, and capacitance C represents the inter-electrode capacitance Cp of panel 10.

Power recovery section 110 establishes the L-C resonance of inter-electrode capacitance Cp and any of inductors L11 and L12 to rise or fall sustaining pulses. To rise the sustaining pulse, an electric charge stored in power recovery capacitor C10 is delivered to inter-electrode capacitance Cp through switching element Q11, diode D11 and inductor L11. To fall the sustaining pulses, the electric charge stored in inter-electrode capacitance Cp is returned to power recovery capacitor C10 through inductor L12, diode D12 and switching element Q12. The sustaining pulses are applied to scan electrodes 22 in this manner. Since power recovery section 110 uses the L-C resonance to drive scan electrodes 22 without receiving electric power from a power supply, it can cut the power consumption to zero in an idealistic theory. Power recovery capacitor C10 needs to have a sufficiently large capacitance as compared with inter-electrode capacitance Cp, and it is charged to a potential of Vs/2, which is about one half of voltage Vs of power supply VS, in order to serve as a power supply of power recovery section 110. Because of a high impedance of power recovery section 110, there can be a significant drop in the voltage applied to scan electrodes 22 attributed to a discharge current if intense sustain discharges occur when scan electrodes 22 are being driven by power recovery section 110. In this exemplary embodiment, however, the voltage of power supply VS is set to so low a potential that it averts sustain discharges from occurring while scan electrodes 22 are driven by power recovery section 110, or even if sustain discharges occur, it controls the discharges to a level not to cause a large drop in the voltage applied to scan electrodes 22 due to the discharge current.

Voltage clamping section 120 connects scan electrodes 22 to power supply VS by means of switching element Q13 to clamp scan electrodes 22 at voltage Vs. Or, voltage clamping section 120 grounds scan electrodes 22 by means of switching element Q14 to clamp scan electrodes 22 at zero volt. Voltage clamping section 120 drives scan electrodes 22 in the manner as described above. Accordingly, voltage clamping section 120 has a small impedance when supplying the voltage, thereby being capable of delivering a large discharge current steadily for the intense sustain discharges.

As described, sustaining pulse generator circuit 100 uses power recovery section 110 and voltage clamping section 120 to apply sustaining pulses to scan electrodes 22 by way of controlling switching elements Q11, Q12, Q13 and Q14. These switching elements can be composed of commonly known devices such as MOS-FET and IGBT.

Sustaining pulse generator circuit 200 comprises power recovery section 210 having power recovery capacitor C20, switching elements Q21 and Q22, reverse-current blocking diodes D21 and D22, and resonance inductors L21 and L22, and clamping section 220 having switching elements Q23 and Q24. Sustaining pulse generator circuit 200 is connected to sustain electrodes 23 represented here by another side of inter-electrode capacitance Cp of panel 10. Description of sustaining pulse generator circuit 200 is skipped since it operates in the same manner as sustaining pulse generator circuit 100. Inductors L21 and L22 used here are also designed to have inductances of a value, of which a resonance cycle with inter-electrode capacitance Cp becomes longer than the time duration of the sustaining pulse.

Although FIG. 6 shows power supply VE for generating voltage Ve1 to reduce the difference in voltage potential between electrodes of the display electrode pairs as well as switching elements Q28 and Q29 for applying the voltage Ve1 to sustain electrodes 23, their functions will be described later on.

Description is provided next of how the sustaining pulse generator circuit operates, and details of the sustaining pulses.

Figure 7:
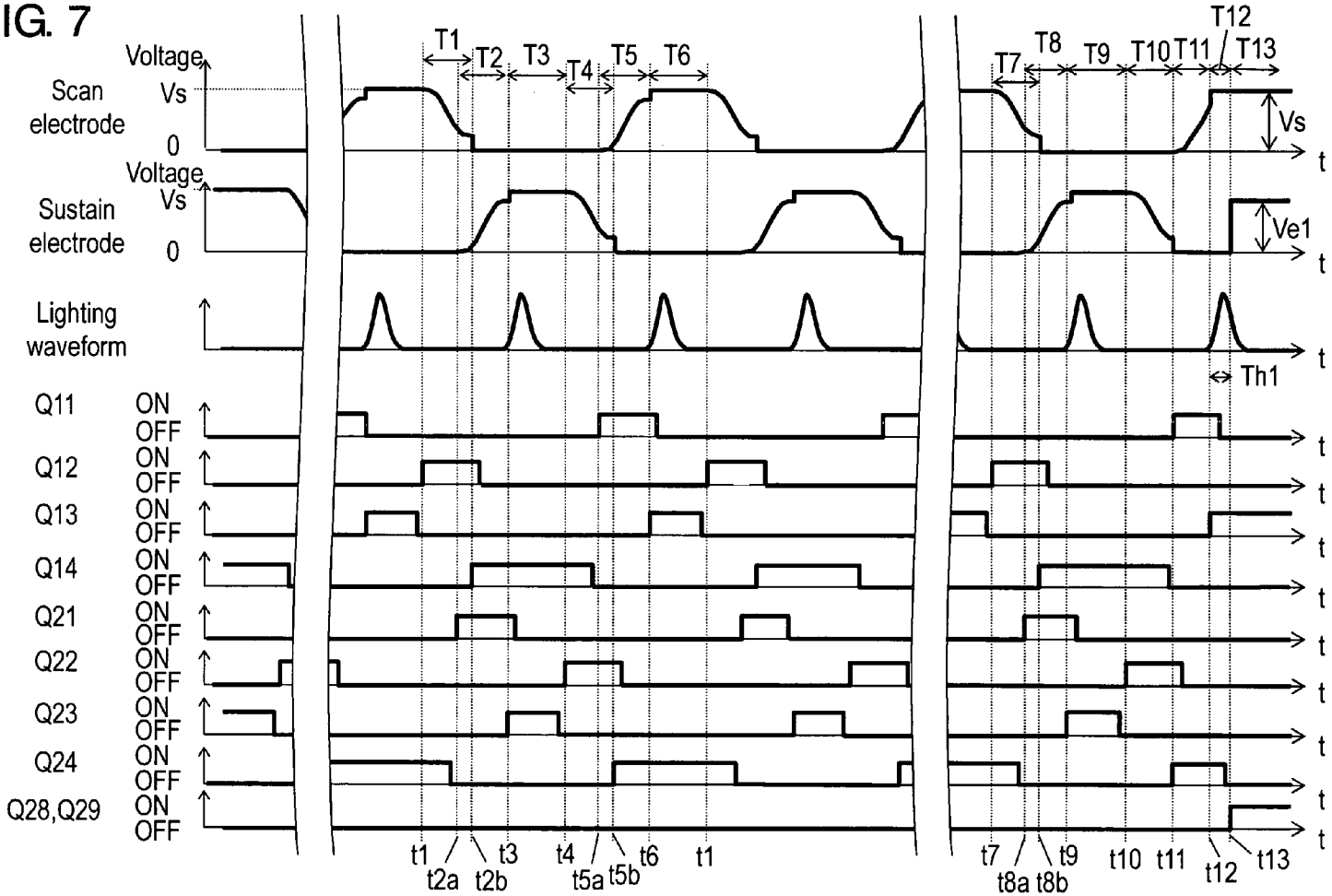
FIG. 7 is a timing chart showing operation of the sustaining pulse generator circuit according to the exemplary embodiment of the invention.

FIG. 7 is a timing chart showing operation of sustaining pulse generator circuits 100 and 200 according to this exemplary embodiment of the invention.

One complete cycle of the repeating sustaining pulse (hereinafter referred to as "sustaining cycle") is divided into six periods as indicated by T1 through T6, each of which will now be discussed. In the following explanation, operations of making and breaking electrical continuity of the switching elements are expressed by the words "ON" and "OFF" respectively. In addition, although FIG. 7 shows waveforms of positive polarity, they are not meant to limit the scope of this invention. For example, waveforms of negative polarity are also adaptable to the present invention to provide the similar advantages, and such an embodiment can be realized by simply replacing the word "rise" in the following explanation of the waveforms of positive polarity with the word "fall", though we choose not to include another exemplary embodiment detailing the waveforms of negative polarity.

(Period T1)

Switching element Q12 is turned ON at time t1. This causes a current to start flowing from scan electrodes 22 to capacitor C10 through inductor L12, diode D12 and switching element Q12, and the voltage of scan electrodes 22 begins to fall. In this exemplary embodiment, the voltage of scan electrodes 22 decreases to nearly zero volt within 1,000 nsec after the time t1 since the resonance cycle of inductor L12 and inter-electrode capacitance Cp is set to 2,000 nsec. However, the voltage of scan electrodes 22 does not fall to zero volt by time t2*b* because the period T1 from the time t1 to the time t2*b*, that is, the fall time of the sustaining pulses produced by using power recovery section 110, is set within a range of 650 nsec to 850 nsec, which is shorter than 1,000 nsec, according to the APL. Switching element Q14 is now turned ON at the time t2*b*. This clamps the voltage of scan electrodes 22 at zero volt because scan electrodes 22 are directly grounded through switching element Q14.

Besides, switching element Q24 is kept ON, and sustain electrodes 23 are clamped at zero volt in the potential. Switching element Q24 then having kept clamping sustain electrodes 23 at zero volt is turned OFF immediately before time t2*a*.

(Period T2)

Switching element Q21 is turned ON at time t2*a*. This causes a current to start flowing from power recovery capacitor C20 to sustain electrodes 23 through switching element Q21, diode D21 and inductor L21, and the voltage of sustain electrodes 23 begins to rise. The voltage of sustain electrodes 23 rises to voltage of approximately Vs within 1,000 nsec after the time t2*a* since the resonance cycle of inductor L21 and inter-electrode capacitance Cp is also set to 2,000 nsec. However, the voltage of sustain electrodes 23 does not rise up to the voltage Vs by time t3 because the period T2 from the time t2*a* to the time t3, or the rise time of the sustaining pulses produced by using power recovery section 210 is set to 900 nsec. Switching element Q23 is now turned ON at the time t3. This clamps the voltage of sustain electrodes 23 at voltage Vs because sustain electrodes 23 are directly connected to power supply VS via switching element Q23.

In this exemplary embodiment, there is provided an overlapping portion between period T1 and period T2. This overlapping portion, or a period from time t2*a* to time t2*b*, is herein referred to as "overlapping period". The overlapping period is set within a range of 250 nsec and 450 nsec according to the APL. The sustaining cycle time can be shortened in this exemplary embodiment by providing the overlapping period.

(Period T3)

When sustain electrodes 23 are clamped at the voltage of Vs, a difference in the voltage potential between scan electrodes 22 and sustain electrodes 23 exceeds the discharge starting voltage in a discharge cell where the address discharge took place, and a sustain discharge hence occurs. Switching element Q23 then having kept clamping sustain electrodes 23 at the voltage Vs is turned OFF immediately before time t4.

The voltage of sustain electrodes 23 is kept at the sustaining pulse voltage Vs in this manner during the period T3, and a time of the period T3 is a duration of the sustaining pulse to be applied to sustain electrodes 23. As stated, the pulse duration means a time, in which the voltage of the sustaining pulses raised by the resonance is clamped at the voltage Vs and maintained for a predetermined time period. In this exemplary embodiment here, the period T3 is set within a range of 850 nsec and 1,250 nsec according to the APL.

All what is required here is to turn OFF switching element Q12 before the time t5*a* following the time t2*b*, and to turn OFF switching element Q21 before the time t4 following the time t3.

(Period T4)

Switching element Q22 is turned ON at time t4. This causes a current to start flowing from sustain electrodes 23 to power recovery capacitor C20 through inductor L22, diode D22 and switching element Q22, and the voltage of sustain electrodes 23 begins to fall. A resonance cycle of inductor L22 and inter-electrode capacitance Cp is also set to 2,000 nsec, while the period T4 from the time t4 to time t5*b*, or the rise time of the sustaining pulses produced by using power recovery section 210 is set within a range of 650 nsec and 850 nsec according to the APL. Therefore, the voltage of sustain electrodes 23 does not fall to zero volt by the time t5*b*.

Switching element Q23 is now turned ON at the time t5*b*. This clamps sustain electrodes 23 at zero volt because sustain electrodes 23 are grounded directly through switching element Q24. Switching element Q14 then having kept clamping scan electrodes 22 at zero volt is turned OFF immediately before time t5*a*.

(Period T5)

Switching element Q11 is turned ON at the time t5*a*. This causes a current to start flowing from power recovery capacitor C10 to scan electrodes 22 through switching element Q11, diode D11 and inductor L11, and the voltage of scan electrodes 22 begins to rise. A resonance cycle of inductor L11 and inter-electrode capacitance Cp is also set to 2,000 nsec, while the fall time of the sustaining pulses produced by using power recovery section 110 is set to 900 nsec. Therefore, the voltage of scan electrodes 22 does not rise up to the voltage Vs by time t6. Switching element Q13 is then turned ON at the time t6. This clamps scan electrodes 22 at the voltage Vs.

In this exemplary embodiment, there is provided an overlapping portion between period T4 and period T5, and this overlapping portion, or a period from the time t5*a* to the time t5*b* is also referred to as "overlapping period". This overlapping period is set within a range of 250 nsec and 450 nsec according to the APL.

(Period T6)

When scan electrodes 22 are clamped at the voltage Vs, a difference in the voltage potential between scan electrodes 22 and sustain electrodes 23 exceeds the discharge starting voltage in a discharge cell where the address discharge took place, and a sustain discharge occurs.

The voltage of scan electrodes 22 is kept at the sustaining pulse voltage Vs in this manner during the period T6, and a time of the period T6 is a duration of the sustaining pulse to be applied to scan electrodes 22. In this exemplary embodiment, the period T6 is also set within the range of 850 nsec and 1,250 nsec according to the APL.

All what is necessary here is to turn OFF switching element Q22 before time t2*a* of the subsequent sustaining cycle following the time t5*b*, and to turn OFF switching element Q11 before time t1 of the subsequent sustaining cycle following the time t6. Moreover, it is desirable to turn OFF switching element Q24 immediately before time t2*a* of the subsequent sustaining cycle, and to turn OFF switching element Q13 immediately before time t1 of the subsequent sustaining cycle in order to decrease output impedances of sustaining pulse generator circuits 100 and 200.

In this exemplary embodiment, sustaining pulse generator circuits 100 and 200 apply a required number of the sustaining pulses to scan electrodes 22 and sustain electrodes 23 by repeating the above operation of the periods T1 through T6.

According to this exemplary embodiment, the resonance cycle of any of inductors L11 and L21 and inter-electrode capacitance Cp is set to be longer than the duration of sustaining pulses, or the period T3 or T6, as discussed (in the periods T1 through T6) above. In addition, the sustaining pulses generated by using power recovery sections 110 and 210 are so configured that twice the period T2 or T5 representing the rising time thereof becomes longer than the period T3 or T6. The sustaining pulses configured as above can reduce a reactive power (i.e., the electric power consumed without contributing to the luminous emission) of sustaining pulse generator circuits 100 and 200, and improve the emission efficiency (i.e., emission intensity vs. power consumption). Described hereinafter is the reason of the above.

We, the inventors of the present invention conducted measurements of reactive power and emission efficiency while changing the resonance cycle of power recovery sections 110 and 210 in order to investigate relations among the resonance cycle and reactive power of power recovery sections 110 and 210, and the emission efficiency. We made our experiment by setting rise time of the sustaining pulses to one half of the resonance cycle of power recovery sections 110 and 210. That is, the rise time is adjusted to 600 nsec and 800 nsec, for instance, when the resonance cycle of power recovery sections 110 and 210 is 1,200 nsec and 1,600 nsec respectively.

Figure 8A:
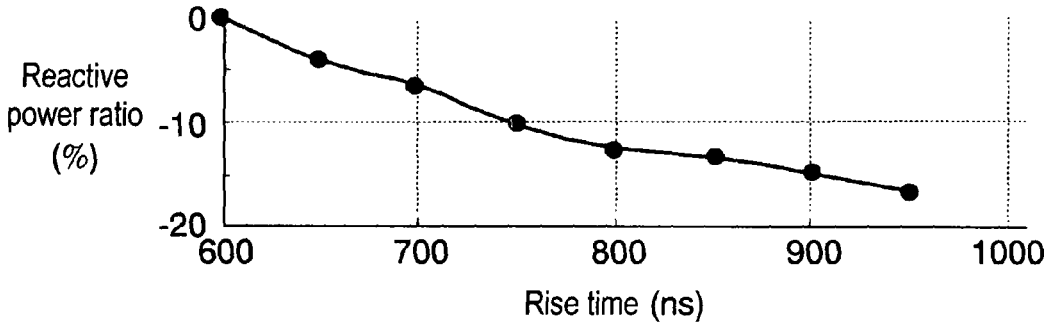
FIG. 8A is a graph showing a relation between rise time of a sustaining pulse and reactive power of the sustaining pulse generator circuit according to the exemplary embodiment of the invention.
Figure 8B:
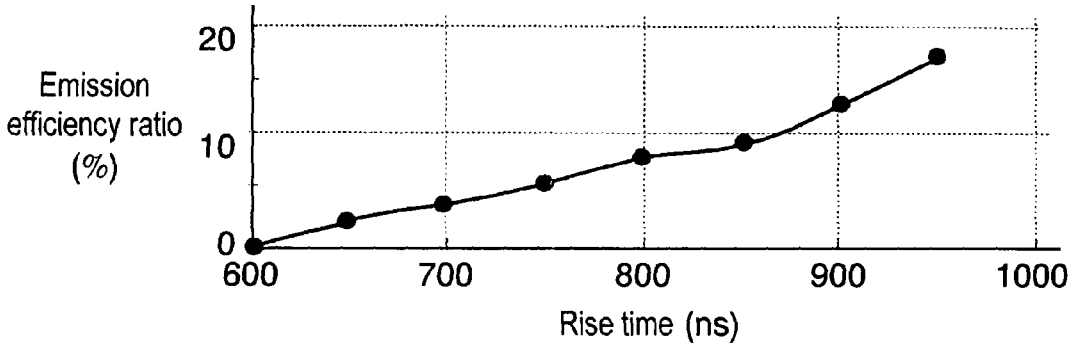
FIG. 8B is a graph showing a relation between rise time of the sustaining pulse and emission efficiency according to the exemplary embodiment of the invention.

FIG. 8A is a graph showing a relation between rise time of the sustaining pulse and reactive power of the sustaining pulse generator circuit according to this exemplary embodiment. FIG. 8B is another graph showing a relation between the rise time of the sustaining pulse and emission efficiency. Both FIG. 8A and FIG. 8B show variations of the reactive power or the emission efficiency in percent as calculated relative to the base values obtained for the rise time of 600 nsec. In FIG. 8A and FIG. 8B, the vertical axes show reactive power ratio and emission efficiency ratio respectively, and horizontal axes of both figures show rise time.

It was found from this experiment that the reactive power of sustaining pulse generator circuits 100 and 200 can be reduced by prolonging the rise time. For example, the reactive power is reduced by about 10% and about 15% when the rise time is changed from 600 nsec to 750 nsec and 900 nsec respectively, as shown in FIG. 8A. It was also found that the emission efficiency can be improved by prolonging the rise time. The emission efficiency is improved by about 5% and about 13% when the rise time is changed from 600 nsec to 750 nsec and 900 nsec respectively, as shown in FIG. 8B.

As shown, it was verified experimentally that not only reduced is the reactive power of sustaining pulse generator circuits 100 and 200 but also improved is the emission efficiency of sustain discharges by virtue of slowing rise of the sustaining pulses to 750 nsec or longer, and more preferably to 900 nsec or longer.

In the driving method discussed above, sustain discharges cannot be produced continuously if duration of the sustaining pulses is excessively short because wall voltages created by the sustain discharges tend to became deficient. If duration of the sustaining pulses is too long, on the contrary, the required number of them cannot be applied to the display electrode pairs due to their prolonged cyclic period. It is therefore desirable for the practical purpose that duration of the sustaining pulses is adjusted to about 800 nsec to 1,500 nsec. In this exemplary embodiment, the periods T3 and T6 corresponding to the duration of the sustaining pulses are set between 850 nsec and 1,250 nsec which is the time suitable for accumulation of the sufficient wall voltages and ensuring the required number of the sustaining pulses.

In consideration of the above conditions, it is known that advantages of reducing the reactive power and improving the emission efficiency can be achieved by configuring the sustaining pulses generated by power recovery sections 110 and 210 so that twice the periods T2 and T5 defining the rising time of the sustaining pulses becomes longer than the periods T3 and T6 representing their durations. It is more desirable that the rise time of the sustaining pulses is set to be longer than the periods T3 and T6. Furthermore, it is possible to prevent the voltage applied to the display electrode pairs from being decreased during the periods T2 and T5, i.e., the rise time of the sustaining pulses, by setting the resonance cycle between any of inductors L11 and L21 and inter-electrode capacitance Cp to a time twice the periods T2 and T5 or longer. Accordingly, there can be obtained such advantageous effects as reducing the reactive power and improving the emission efficiency by setting the resonance cycle longer than the periods T3 and T6, or the duration of the sustaining pulse. It is further desirable to set the resonance cycle so that a time obtained by multiplying it by a factor of 0.5 to 0.75 becomes longer than the periods T3 and T6.

While one complete sustaining cycle is defined from the period T1 to the period T6, the sustaining cycle of this exemplary embodiment includes an overlapping period where the period T1 overlaps the period T2 from time t2*a* to time t2*b*, and another overlapping period where the period T4 overlaps the period T5 from time t5*a* to time t5*b*. These overlapping periods shorten the sustaining cycle by a time corresponding to a length of the overlapped portions. Since this shortens the driving time of one field, the shortened portion of the driving time can br used to raise the peak brightness of display images by increasing the multiplying factor of brightness and the number of sustaining pulses.

According to this exemplary embodiment, sustaining pulse generator circuits 100 and 200 are independently provided with inductors L11 and L21 which determine the resonance cycle for rising the sustaining pulses, and inductors L12 and L22 which determine another resonance cycle for falling the sustaining pulses. Because of this structure, all what is required is to change values of inductors L11 and L21 or inductors L12 and L22 when the rise time or the fall time of the sustaining pulses is changed so as to make it adaptable to panels of various specifications. It is preferable that the resonance cycle for each of the rise time and the fall time of the sustaining pulses is adjustable independently, especially when prolonging the rise time to slow down rising of the sustaining pulses, as described above.

Moreover, there can be obtained an advantageous effect of cutting an amount of heat produced by each of the inductors into one half and reducing their thermal resistances by using the structure, in which inductors L11 and L21 as well as inductors L12 and L22 are provided independently in power recovery sections 110 and 210.

In the embodiment described above, there is not so large a difference between the rise time and the fall time of the sustaining pulses. Therefore, the resonance cycle for rising the sustaining pulses and another resonance cycle for falling the sustaining pulses in power recovery sections 110 and 210 are set to be the same value, so that inductors L11 and L21 and inductors L12 and L22 are also of the same inductance.

Next, description is provided in detail of how a difference in potential is provided between electrodes of the display electrode pairs for creating an erase discharge in the latter half of the sustaining period. Description is skipped for periods T7, T8, T9 and T10 shown in FIG. 7 since they are same as the period T1, T2, T3 and T4.

(Period T11)

Switching element Q11 is turned ON at time t11. This causes a current to start flowing from power recovery capacitor C10 to scan electrodes 22 through switching element Q11, diode D11 and inductor L11, and the voltage of scan electrodes 22 begins to rise. In this exemplary embodiment, a rise time of the last sustaining pulse in the period T11 from the time t11 to time t12, or the sustaining period, is set to be 650 nsec, which is shorter than the rise time of 900 nsec (i.e., period T2 and period T5) of the other sustaining pulses. Switching element Q13 is then turned ON at time t12 before the voltage of scan electrodes 22 rises close to voltage Vs. This establishes a connection of scan electrodes 22 to power supply VS directly through switching element Q13, and clamps scan electrodes 22 at the voltage Vs.

(Period T12)

When the voltage of scan electrodes 22 rises steeply to voltage Vs, a difference in the voltage potential between scan electrodes 22 and sustain electrodes 23 exceeds the discharge starting voltage in a discharge cell where the sustain discharge took place, and a sustain discharge occurs. Switching element Q24, then having kept clamping sustain electrodes 23 at zero volt is turned OFF immediately before time t13.

(Period T13)

Switching elements Q28 and Q29 are turned ON at the time t13. This establishes a connection of sustain electrodes 23 directly to erase power supply VE through switching elements Q28 and Q29, and steeply rises the voltage of sustain electrodes 23 to the level of Ve1. The time t13 is a moment before the sustain discharge created during the period T12 comes to end, that is, while charged particles generated by the sustain discharge still remain sufficiently in the discharge space. Since electric field inside the discharge space changes while the charged particles still remain sufficiently, the charged particles are rearranged in a manner to neutralize the changed electric field so as to form wall charges. At this moment, the wall voltages on scan electrodes 22 and sustain electrodes 23 are decreased since a difference in voltage potential is small between the voltage Vs applied to scan electrodes 22 and the voltage Ve1 applied to sustain electrodes 23.

As described, the time interval from time t12 to time t13, or the period T12 is an interval from the time when the voltage Vs for producing the last sustain discharge is applied to scan electrodes 22 to another time when the voltage Ve1 is applied to sustain electrodes 23. The difference in potential between electrodes of the display electrode pairs can be reduced by application of this voltage Ve1 to sustain electrodes 23 before the last sustain discharge comes to end. A difference in phase during the interval from the time when the voltage Vs for producing the last sustain discharge is applied to scan electrodes 22 to the time when the voltage Ve1 is applied to sustain electrodes 23 becomes a shape of narrow-width pulse, and its pulse width represents erase phase difference Th1. Therefore, the sustain discharge produced at the very end becomes a discharge called an erase discharge.

A positive wall voltage is accumulated on data electrodes 32 during this period, since data electrodes 32 are maintained at the potential of zero volt and the charged particles form wall charges in a manner to decrease the potential difference between the voltages applied to data electrodes 32 and scan electrodes 22.

In this exemplary embodiment, a time of period T12 representing the erase phase difference Th1 is set to 350 nsec. In addition, a time of period T11 representing the rise time of the last sustaining pulse in the sustaining period is set to 650 nsec, which is shorter than 900 nsec provided as the periods T2 and T5 for the rise time of the other sustaining pulses.

Described hereinafter is the reason why the erase phase difference Th1 is set to 350 nsec and the rise time of the last sustaining pulse in the sustaining period is set to a shorter time of 650 nsec than the rise time of the other sustaining pulses, as stated above (for the periods T11 to T13).

The inventors of the present invention conducted an experiment to investigate a relation of voltage Ve1 applied to sustain electrodes 23 during the priming period with respect to erase phase difference Th1 and the rise time of the last sustaining pulse. It is desirable to decrease voltage Ve1 applied to sustain electrodes 23 in order to increase a margin of the driving voltage since there is a possibility of malfunction that an address discharge occurs in a discharge cell not applied with an addressing pulse if voltage Ve1 is set too high.

Figure 9:
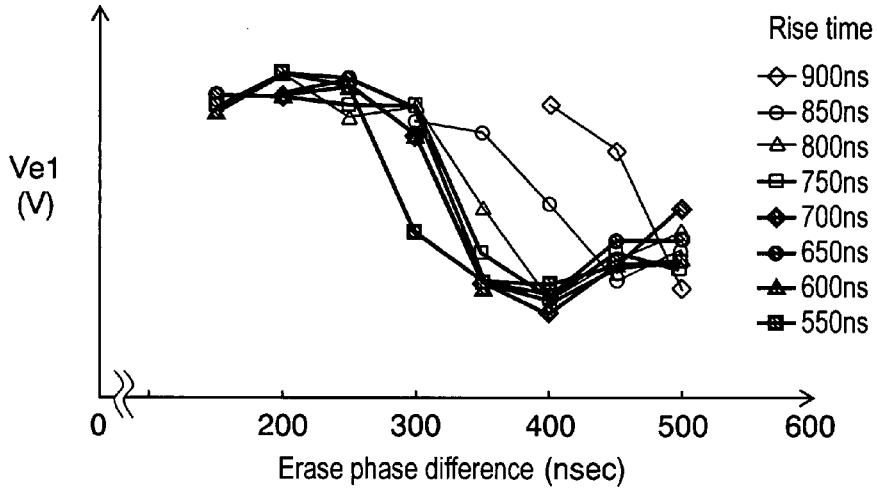
FIG. 9 is a graph showing a relation among voltage Ve1, erase phase difference Th1 and rise time of the last sustaining pulse.

FIG. 9 is a graph showing a relation of voltage Ve1 necessary to carry out the normal selective priming operation in the priming period with respect to erase phase difference Th1 and the rise time of the last sustaining pulse. The horizontal axis shows erase phase difference Th1 and the vertical axis shows voltage Ve1. Results of the experiment showed that voltage Ve1 necessary to carry out the normal selective priming operation can be decreased by selecting a rise time of 800 nsec or less for the last sustaining pulse and erase phase difference Th1 of 350 nsec to 400 nsec. In this exemplary embodiment, erase phase difference Th1 of 350 nsec and rise time of 650 nsec for the last sustaining pulse are selected based on these experimental results. The above embodiment widens the driving margin for the addressing operation by virtue of decreasing the voltage Ve1 applied to the sustain electrodes, and achieves a stable priming discharge and address discharge.

Additionally, we the inventors found from the experiment that the voltage Ve1 necessary to carry out the normal selective priming operation can be decreased further when the rise time of another sustaining pulse second from the last in the sustaining period, or the period T8 in FIG. 7, is reduced to less than 900 nsec.

Figure 10:
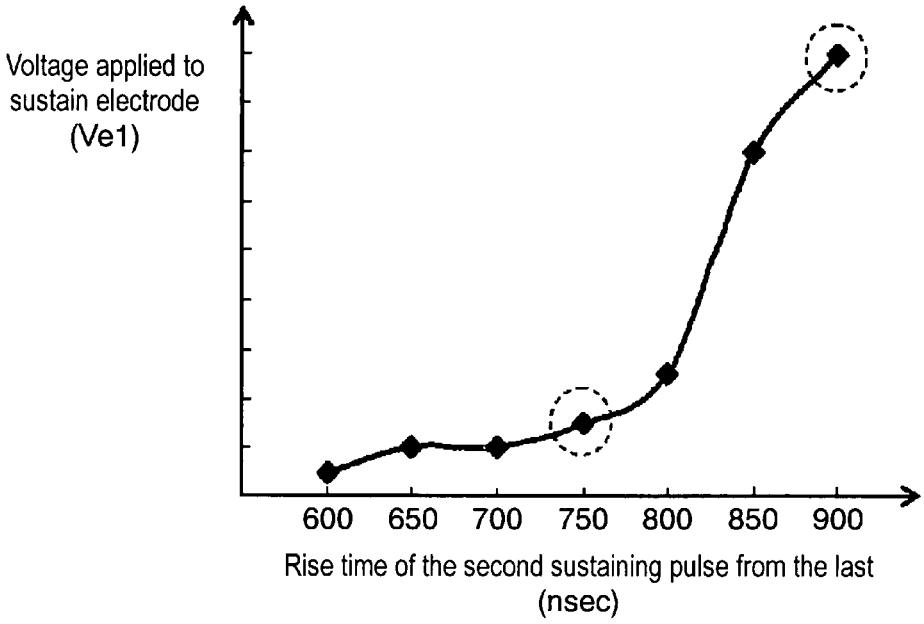
FIG. 10 is a graph showing a relation between rise time of a second sustaining pulse from the last one and voltage Ve1

FIG. 10 is a graph showing a relation between rise time of the second sustaining pulse from the last one and voltage Ve1, wherein the horizontal axis shows the rise time of the second sustaining pulse from the last, and the vertical axis shows the voltage Ve1. Results of the experiment revealed that the voltage Ve1 can be decreased by selecting a rise time of 800 nsec or less for the second sustaining pulse from the last one. It was also revealed at the same time that the required voltage Ve1 does not change significantly by further decrease of the rise time. As a result of the above and in consideration of the efficiency of using recovered electric power, the rise time of 750 nsec is chosen in this exemplary embodiment for the second sustaining pulse from the last. This further decreases the voltage Ve1 required for application to the sustain electrodes to create the normal priming discharge, and achieves even a larger driving margin.

We, the inventors then conducted another experiment to investigate a relation of applied voltage of sustaining pulse required to produce a sustain discharge (hereinafter called as "lighting voltage") with respect to ratio of a number of discharge cells where a sustain discharge occurs against a total number of discharge cells (called "lighting rate"), and sustaining cycle.

Figure 11:
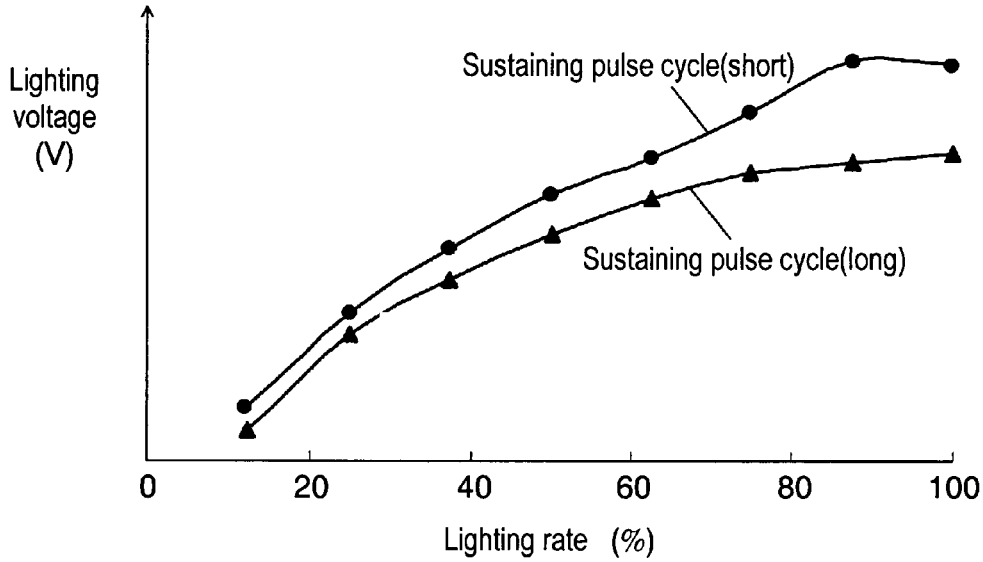
FIG. 11 is a graph showing a relation between lighting rate and lighting voltage with sustaining cycle as a parameter according to the exemplary embodiment of the invention.

FIG. 11 is a graph showing the relation between the lighting rate and the lighting voltage with the sustaining cycle as a parameter according to this exemplary embodiment, wherein the vertical axis shows the lighting voltage and the horizontal axis shows the lighting rate. Sustaining cycles taken here are 3.8 μsec and 4.8 μsec. It was found from this experiment that the lighting voltage falls when the lighting rate is low, and the lighting voltage rises when the lighting rate is high. Also found is that the lighting voltage rises when the sustaining cycle becomes shorter, and the lighting voltage falls when the sustaining cycle becomes longer.

The reason of the lighting voltage to rise as the lighting rate becomes higher is thought to be that a discharge current increases when the lighting rate goes up, for instance, which in turn increases a voltage drop attributable to a resistance component etc. of the display electrode pairs, and decreases the voltage applied between the display electrode pairs inside the discharge cells, thereby resulting in an increase in the apparent lighting voltage. Also, the reason of the lighting voltage to rise as the sustaining cycle becomes shorter is thought to be that the duration of the sustaining pulse is shortened when the sustaining cycle is shortened, which decreases the wall voltage accumulated by the sustain discharge, thereby raising the sustaining pulse voltage to be applied to the display electrode pairs.

For a subfield, of which a brightness weight is large, a lighting rate becomes low in general, when an image of low APL is displayed. Therefore, the lighting voltage also decreases as described above. This fact indicates that it is possible to shorten the sustaining cycle of any subfield, of which the brightness weight is large when an image of low APL is displayed.

In the present exemplary embodiment, it is for this reason to drive with the sustaining pulse of a shortened duration in the subfield carrying a large brightness weight when displaying an image of low APL. In addition, this exemplary embodiment additionally shortens the sustaining cycle by prolonging an overlapping period between the rise time and fall time of the sustaining pulses while shortening the fall time of the sustaining pulses when displaying an image of low APL. There is a tendency, however, that the reactive power increases if the overlapping period of the sustaining pulses is increased excessively or the fall time of the sustaining pulses is shortened exceedingly. In this exemplary embodiment, therefore, the overlapping period of the sustaining pulses is adjusted to 250 nsec to 450 nsec, and the fall time of the sustaining pulses is set to 650 nsec to 850 nsec in consideration of discharge characteristics, their variations and the like of panels. The shortened driving time is used to increase a number of the sustaining pulses by raising the multiplying factor of brightness to hence improve a peak brightness of the display image.

FIG. 12 is a table showing a relation between APL and waveform of the sustaining pulse in a plasma display unit according to the present exemplary embodiment. In this exemplary embodiment, overlapping periods of the sustaining pulses are set to 450 nsec from the eighth SF to the tenth SF, the fall time of the sustaining pulses to 650 nsec, and the sustaining cycle to 3,900 nsec, when displaying an image of lower than 20% in the APL. When displaying an image of 20% or higher but lower than 25% in the APL, overlapping periods of the sustaining pulses are set to 400 nsec from the ninth SF to the tenth SF, the fall time of the sustaining pulses to 700 nsec, and the sustaining cycle to 4,300 nsec. When displaying an image of 25% or higher but lower than 35% in the APL, overlapping periods of the sustaining pulses are set to 350 nsec from the ninth SF to the tenth SF, the fall time of the sustaining pulses to 750 nsec, and the sustaining cycle to 4,700 nsec. When displaying an image of 35% or higher but lower than 50% in the APL, overlapping periods of the sustaining pulses in the tenth SF are set to 300 nsec, the fall time of the sustaining pulses to 800 nsec, and the sustaining cycle to 5,100 nsec. Moreover, when displaying an image of 50% or higher in the APL, overlapping periods of the sustaining pulses in the tenth SF are set to 250 nsec, the fall time of the sustaining pulses to 850 nsec, and the sustaining cycle to 5,500 nsec. It was made possible by the above embodiment to increase the multiplying factor of brightness to a maximum of 4.3 times.

According to this exemplary embodiment, as has been described, the sustaining cycle is shortened in the subfields carrying a large brightness weight when displaying an image of low APL. The shortened driving time is then used to increase the number of the sustaining pulses by raising the multiplying factor of brightness to improve a peak brightness of the display image. However, the shortened driving time may be used for other purposes such as improvement of quality of the image displayed by increasing a number of displayable gradations, or further stabilization of electrical discharges by increasing the whole cell priming operations.

It was discovered, however, that the addressing pulse voltage Vd needs to be set higher in order to produce the address discharges reliably, if the sustaining cycle and duration of sustaining pulses are only simply shortened. It is believed that this is attributed to a deficiency of the wall voltage accumulated on the data electrodes due to an erase discharge during the period T12 shown in FIG. 7, which makes it necessary to increase the addressing pulse voltage Vd to supplement the deficiency during the addressing period. The inventors therefore made a study to lower the addressing voltage Vd, and as a result, we found it possible to bring the addressing pulse voltage down to the original level by prolonging the duration of the sustaining pulse for producing the sustain discharge immediately before the erase discharge, i.e., the period T8 in FIG. 7.

FIG. 13 is a table showing a result of the experiment conducted to examine the relation between sustaining cycle, duration and the addressing voltage Vd required to positively produce an address discharge. As shown, the addressing voltage rose from 62V to 66.5V when the sustaining cycle was shortened from 5 μsec to 4 μsec. However, the addressing voltage could be brought back to the original 62V by prolonging the duration of the sustaining pulse immediately before the erase discharge to 1,000 nsec and the sustaining cycle to 5 μsec or longer, even when the sustaining cycle was 4 μsec. It was also made obvious at the same time that the addressing voltage does not decrease any further even when duration of the second and the third sustaining pulses before the last pulse is prolonged in addition to the last pulse just before the erase discharge. Therefore, it is acceptable to prolong the duration of the second or the third sustaining pulse before the last one if there is a sufficient time for driving, although it only need to prolong the duration of the one just before the erase discharge in order to lower the addressing pulse voltage.

Although the sustaining pulse voltage Vs must be sufficiently high to positively produce the sustain discharge, as a matter of course, it is desirable that the sustaining pulse voltage Vs is set low to an extent that the discharge current is spread, as explained with reference to FIG. 6 for operation of power recovery sections 110 and 210. If voltage Vs is too high, a highly intense sustain discharge may be produced and a large discharge current flows during the periods T2 and T5, in which a sustaining pulse is applied to scan electrodes 22 or sustain electrodes 23 by using power recovery sections 110 and 210. If a large discharge current flows, it results in a voltage drop, which substantially lowers the voltage applied to scan electrodes 22 or sustain electrodes 23 because power recovery sections 110 and 210 have high impedances, thereby making the sustain discharge unstable and giving rise to a possibility of degrading the quality of displayed images such as loss of uniformity of the luminous intensity in the display area.

In this exemplary embodiment, the sustaining pulse voltage Vs is set to 190V. Although the value of this voltage itself is not specially low as compared with sustaining pulse voltages of generally available plasma display units, panel 10 used in this exemplary embodiment contains xenon gas with an increased partial pressure of 10% to improve the emission efficiency, which results in a high discharge starting voltage between the display electrode pairs. This makes a value of sustaining pulse voltage Vs comparatively low in proportion to the discharge starting voltage. In other words, it is highly unlikely that this voltage causes a sustain discharge during the periods T2 and T5, in which the voltage is applied to the display electrode pairs by using power recovery sections 110 and 210, or even if a sustain discharge occurs, it will not become so intense to make the sustain discharge unstable due to a decrease in the voltage applied to the display electrode pairs by a voltage drop attributable to the discharge current.

As discussed, this exemplary embodiment makes driving possible to achieve a high emission efficiency. On the other hand, however, the sustaining pulse voltage is set to be relatively low in the value as compared to the discharge starting voltage. For this reason, there is a risk of not producing the sustain discharges continuously due to a deficient wall voltage if the wall voltage is not accumulated properly by the sustain discharges. There is a tendency of high probability that such a problem occurs especially when there is a variation in discharge characteristic of the discharge cells constituting the display screen. Therefore, it can be an alternative configuration that the rise time of the first sustaining pulse is set shorter than the rise time of the other sustaining pulses in order to reliably establish a sufficient wall voltage at the first sustain discharge in the sustaining period.

Figure 14:
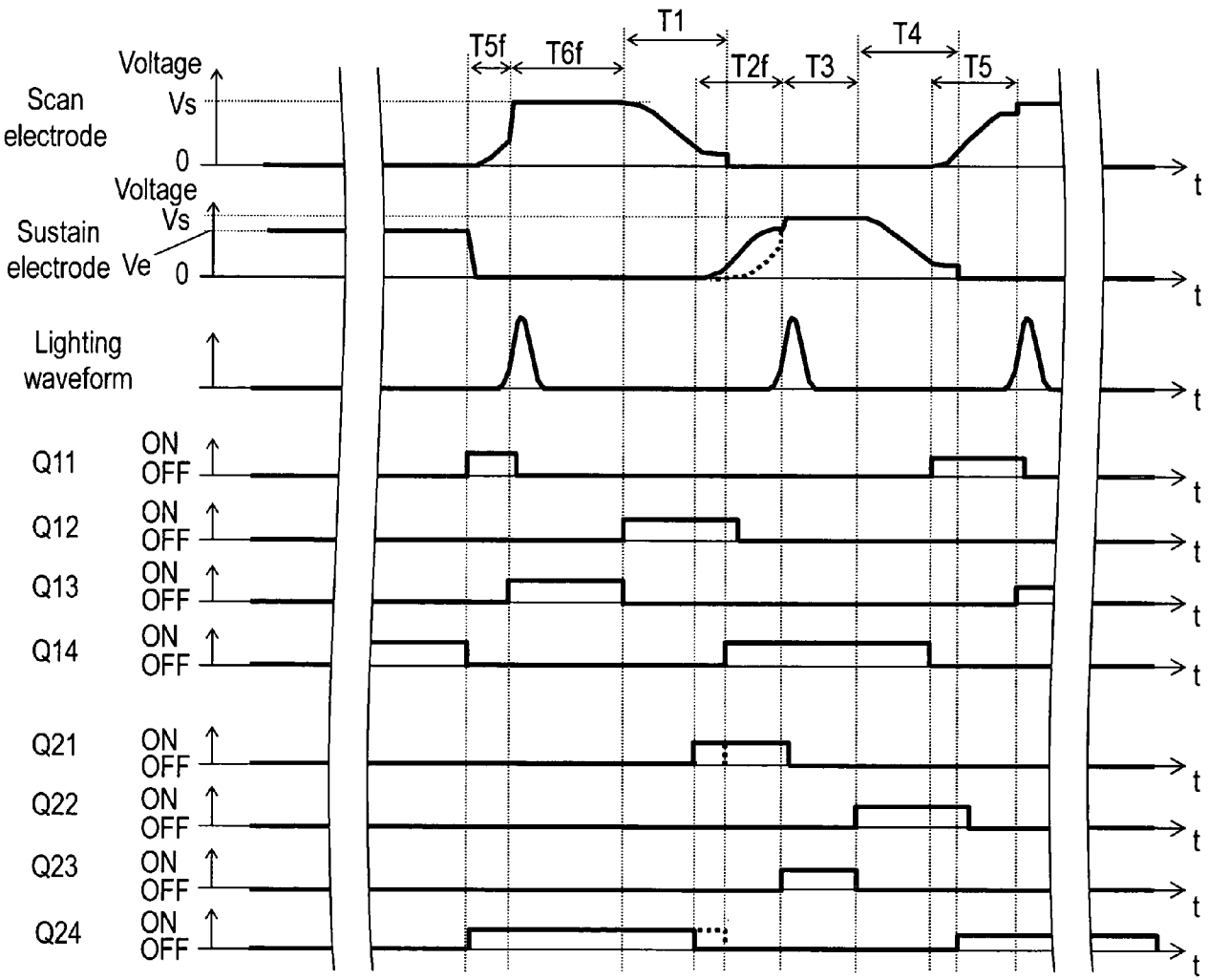
FIG. 14 is a schematic illustration showing waveforms of driving voltages applied to individual electrodes of the panel according to another exemplary embodiments of the invention.

FIG. 14 is an illustration showing an example of waveforms of driving voltages applied to the individual electrodes of panel 10. In this example, period T5*f* representing a rise time of the first sustaining pulse is set to 500 nsec. In this way, it is possible to produce an intense sustain discharge to ensure establishment of the wall voltage by making the rise time of the first sustaining pulse shorter than the period T5, or the rise time of the normal sustaining pulses, thereby achieving stable sustain discharges continuously even for panels having variations of a certain extent in the discharge characteristic with their discharge cells. It is also appropriate to use another configuration, in which some sustaining pulses with such a short rise time are inserted at suitable intervals so long as they do not increase the power consumption substantially.

In the exemplary embodiment of the present invention, as discussed above, 900 nsec is chosen as the periods T2 and T5 to represent the rise time of the sustaining pulses. However, these periods T2 and T5 can be of any time period as long as they are one half of the resonance cycle, and that twice the periods T2 and T5 is longer than the periods T3 and T6 defining the duration of the sustaining pulses. It is to be noted that an upper limit of the rise time and fall time of the sustaining pulses is restricted by a cyclic period of the sustaining pulses, and it does not exceed the time period of one field.

In this exemplary embodiment, the overlapping periods are set between 250 nsec and 450 nsec, in which the periods T2 and T5 representing the rise time of the sustaining pulses overlap the periods T1 and T4 representing the fall time respectively. It is preferable, however, that the values are not smaller than 200 nsec and not larger than 500 nsec in view of reducing power consumption of the driver circuit.

In this exemplary embodiment, the periods T1 and T4 representing the fall time of the sustaining pulses is set to be shorter than the periods T2 and T5 for the rise time of the other sustaining pulses. In this case, however, inductors L11 and L21 for determining the resonance cycle for the rise time of the sustaining pulses may each has an inductance of a larger value than that of inductors L12 and L22 for determining the resonance cycle for the fall time.

In this exemplary embodiment, although a difference of 50 nsec is chosen between the periods T2 and T5 representing the rise time of the sustaining pulses and the periods T1 and T4 representing the fall time, it is desirable for this difference in time period to be not shorter than 2.5% and not longer than 25% of the resonance cycle.

In this exemplary embodiment, although what has been described is an example, in which the sustaining cycle and other factors are controlled according to APL of an image signal, the present invention does not necessarily require to control the sustaining cycle and the like factors.

Moreover, the present invention does not limit the voltage waveforms of the last sustaining pulse in the sustaining period to those discussed above.

Furthermore, although the discharge gases used in this exemplary embodiment contain xenon gas of 10% in the ratio of partial pressure, other value of the partial pressure may also be used by setting a proper driving voltage according to panels used.

It should be understood that the specific values discussed in the present exemplary embodiment are merely an example, and it is therefore desirable that suitable values be chosen according to characteristics of panels and specifications and other variables of plasma display units.

The method of driving panels and the plasma display units of the present invention have advantages of reducing power consumption remarkably while also achieving high brightness. The invention is therefore useful for driving panels and for plasma display units.

The invention claimed is:

1. A method of driving a plasma display panel provided with a plurality of discharge cells, each discharge cell having a display electrode pair formed of a scan electrode and a sustain electrode, one field of the plasma display comprising a plurality of subfields with each subfield having an addressing period for producing an address discharge selectively in any of the discharge cells, and a sustaining period for producing a sustain discharge by applying a number of sustaining pulses corresponding to a weight of brightness in the discharge cell where the address discharge has been produced, the method comprising the steps of:

driving a rise or a fall of sustaining pulses by producing a resonance between an inter-electrode capacitance of a display electrode pair and an inductor;

clamping a voltage of the sustaining pulses at a predetermined potential;

setting a time of the sustaining pulses so that twice a time of driving the rise of the sustaining pulses becomes equal to or longer than a duration of the sustaining pulses; and setting a resonance cycle of the inter-electrode capacitance of the display electrode pair and the inductor to be twice or longer than the time of driving the rise of the sustaining pulses.

2. The method of driving a plasma display panel of claim 1 further comprising the step of:

setting an overlapping period for overlapping the time of driving a rise of a sustaining pulse applied to one of the display electrode pairs with a time of driving a fall of another sustaining pulse applied to another of the display electrode pairs.

3. The method of driving a plasma display panel of claim 2, wherein the overlapping period is in the range of 200 nsec to 500 nsec.

4. A plasma display unit comprising:

a plasma display panel provided with a plurality of discharge cells, each discharge cell having a display electrode pair formed of a scan electrode and a sustain electrode; and a sustaining pulse generator circuit for applying a sustaining pulse to each of the display electrode pairs to generate a sustain discharge, the sustaining pulse generator circuit comprising:

a power recovery section for controlling a rising or a falling of a sustaining pulse by producing a resonance between an inter-electrode capacitance of a display electrode pair and an inductor; and a clamping section for clamping a voltage of the sustaining pulse at a predetermined potential, wherein the power recovery section regulates the sustaining pulse so that twice a time of the rising of the sustaining pulse becomes equal to or longer than a duration of the sustaining pulses, and sets a resonance cycle of the inter-electrode capacitance of the display electrode pair and the inductor to be twice or longer than the time of the rising of the sustaining pulse.

5. The plasma display unit of claim 4, wherein the sustaining pulse generator circuit causes a time of driving a rise of a sustaining pulse applied to one of the display electrode pairs to overlap with a time of driving a fall of another sustaining pulse applied to another of the display electrode pairs.

6. The plasma display unit of claim 4, wherein one inductor for driving a rise of a sustaining pulse, and another inductor for driving to a fall of a sustaining pulse are independently provided.

7. The method of driving a plasma display panel of claim 1, further comprising:

controlling an overlapping period according to an average brightness level (APL).

8. The method of driving a plasma display panel of claim 1, further comprising:

increasing an overlapping period when an average brightness level (APL) is low, and decreasing the overlapping period when the APL is high.

9. The plasma display unit of claim 4, wherein the sustaining pulse generator circuit controls an overlapping period according to an average brightness level (APL).

10. The plasma display unit of claim 4, wherein the sustaining pulse generator circuit increases an overlapping period when an average brightness level (APL) is low, and decreases the overlapping period when the APL is high.

* * * * *